US005618484A

United States Patent [19]

Mogensen et al.

[11] Patent Number: 5,618,484

[45] Date of Patent: Apr. 8, 1997

[54] METHOD AND APPARATUS FOR MANUFACTURING MOULDS OR MOULD PARTS BY COMPACTING PARTICULATE MATERIAL

[75] Inventors: Vagn Mogensen, Gentofte; Jan B. Johansen, Humlebaek, both of Denmark

[73] Assignee: Dansk Industri Syndikat A/S, Herlev, Denmark

[21] Appl. No.: 272,045

[22] Filed: Jul. 8, 1994

[30] Foreign Application Priority Data

Jul. 20, 1993 [DK] Denmark ..... 0858/93

[51] Int. Cl.[6] ..... B22C 19/04

[52] U.S. Cl. ..... 264/220; 264/40.5; 164/24; 164/154.1; 164/456; 425/149

[58] Field of Search ..... 425/149, 408; 164/24, 154.1, 157, 322, 456; 264/219, 220, 40.5

[56] References Cited

U.S. PATENT DOCUMENTS 4,718,842 1/1988 Labbe et al. ..... 264/40.5 X 4,791,974 12/1988 Larsen ..... 164/7.1

5,202,067 4/1993 Solazzi et al. ..... 425/149 X

FOREIGN PATENT DOCUMENTS 1090489 5/1984 U.S.S.R. .

*Primary Examiner*—Robert J. Warden

*Assistant Examiner*—E. Leigh Dawson

*Attorney, Agent, or Firm*—Larson and Taylor

[57] ABSTRACT

When compacting mold sand in a mold chamber (not shown) to form a mold or mold part (not shown) by using two co-operating squeeze plates with associated patterns (not shown), in which one squeeze plate is actuated before the other one, the second squeeze plate is not acuated until the pressure in the mold chamber (or a parameter depending on or derived from this pressure) has reached a predetermined value. By proceeding in this manner it is possible to manufacture molds or mold parts in series with practically the same hardness or solidity.

9 Claims, 4 Drawing Sheets

METHOD AND APPARATUS FOR MANUFACTURING MOULDS OR MOULD PARTS BY COMPACTING PARTICULATE MATERIAL

TECHNICAL FIELD

The present invention relates to a method for manufacturing molds or parts of such molds by compacting particulate material, and in particular to the initiation of the movement of a second squeeze member in dependance on the instantaneous state of the particulate material compacted by a first squeeze member

BACKGROUND ART

In the European Patent Application No. 0,172,937, the British Patent Applications Nos. 2,031,767 and 2,245,204 and the Soviet Invention Description No. 1,090,489, methods are disclosed, in which to begin with solely the first squeeze member is moved, upon which the second squeeze member is moved when some parameter relating to the mold chamber has reached a predetermined value. According to these publiccations, the parameter is constituted by or depends on the length of the path of movement carried out by the first squeeze member during the compacting operation. Thus, the control of the initiation of the movement of the second squeeze member is not based on sensing parameters expressing the instantaneous state of the particulate material, e.g. mold sand, having compacted during the first stage of the compacting process, i.e., during the period in which only the first squeeze member moves.

DISCLOSURE OF THE INVENTION

It is on the above background the object of the present invention to provide a method of the kind referred to initially, with which the initiation of the movement of the second squeeze member can be controlled in dependence on the instantaneous state of the particulate material in the mold chamber, the aim of this control being to be able to manufacture molds or mold parts with substantially uniform solidity in series or mass production, and this object is achieved according to the present invention proceeding as set forth hereafter. By using the pressure in the mold chamber or a parameter depending upon or derived from this pressure, the pressure with which the individual particles are pressed together and which is of substantial importance for the solidity of the finished mold body, will more or less directly be included as a control parameter used for initiating the movement of the second squeeze member constituting the second stage of the compacting process.

The present invention also relates to an apparatus for carrying out the method according to the invention. This apparatus is of the kind set forth in the preamble of claim 4, and is according to the invention characterized by the feature set forth in the characterizing clause of this claim 4.

Advantageous embodiments of the method and the apparatus, are also explained in more detail in the following detailed portion of the present description.

BRIEF DESCRIPTION OF THE DRAWINGS

In the following detailed portion of the present description, the invention will be explained in more detail with reference to the exemplary embodiment of an apparatus according to the invention and various exemplary embodiments of process diagrams that may be used as basis for programming the control means for the apparatus, whereas

DESCRIPTION OF THE PREFERRED EMBODIMENTS

Figure 1:
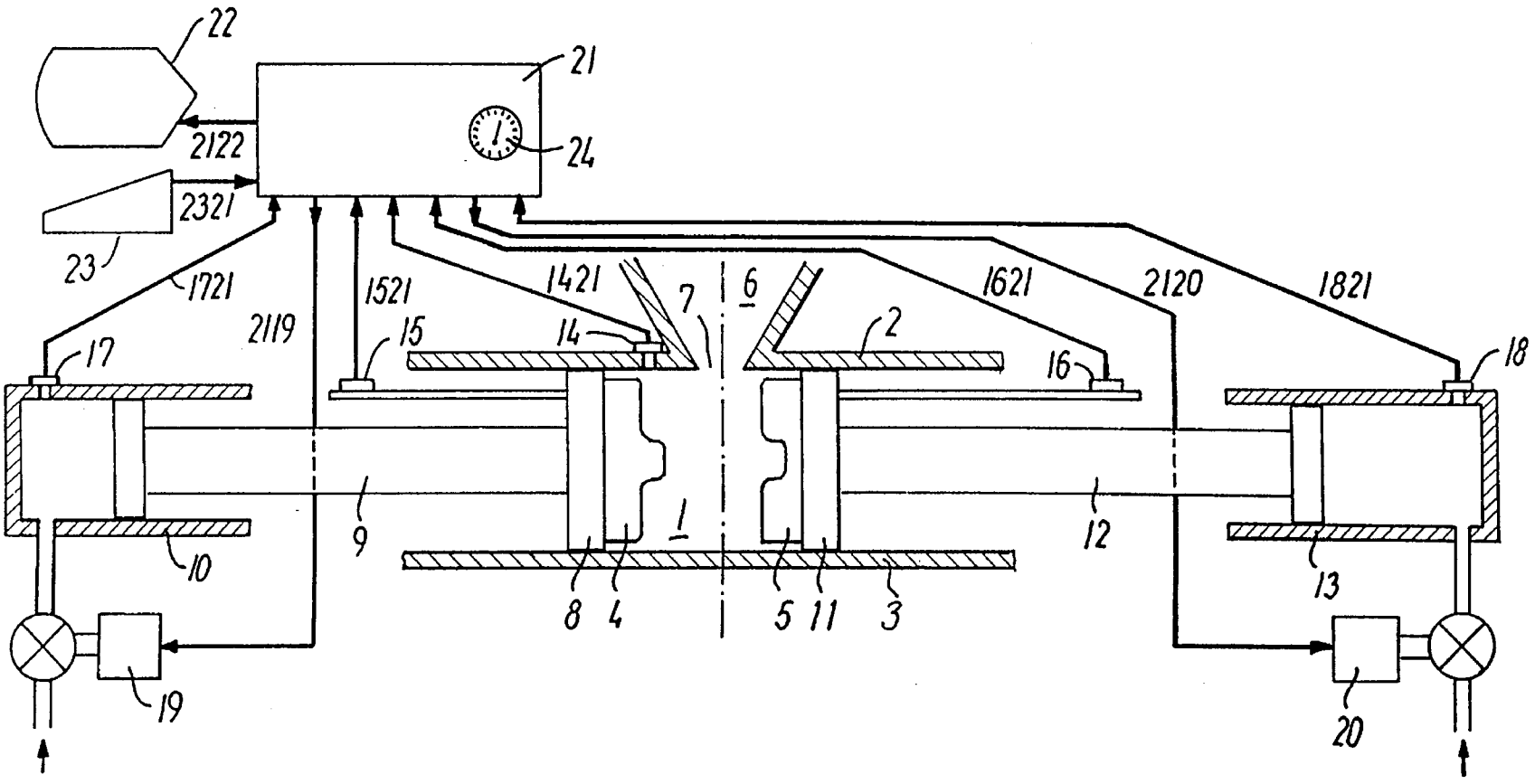
FIG. 1 shows the apparatus seen in elevation and in longitudinal section, with the relevant sensing and control means drawn symbolically.

The exemplary embodiment of an apparatus according to the invention shown, partly in symbolic form, in FIG. 1 comprises in a manner known per se the following mechanical main components:

- a mold chamber 1, limited by an upper wall 2, a bottom wall 3, two side walls in front of and behind the sectional plane of the drawing and hence not visible on the drawing, as well as a first pattern 4 and a second pattern 5.
- A hopper 6, debouching below through an outlet 7 into the uppermost part of the mold chamber 1,
- a first squeeze plate 8, connected to the piston in a first hydraulic cylinder 10 through a first piston rod 9, and
- a second squeeze plate 11, connected to the piston in a second hydraulic cylinder 13 through a second piston rod 12, whereas the first and second patterns 4 and 5 are secured to the side of the first squeeze plate 8 and the second squeeze plate 11 respectively facing toward the mold chamber 1.

A mold for casting or a part for such a mold consisting of mold sand may be manufactured in a manner known per se by introducing a suitable quantity of mold sand in the hopper 6, said sand being blown quickly down into the mold chamber 1 by means of blowing-in means (not shown), upon which the hydraulic cylinders 10 and 13 are actuated to move the squeeze plates 8 and 11 and with them the patterns 4 and 5 towards each other, so that the mold sand having been introduced is compacted so as to form the casting mold or mold part desired.

In addition to the mechanical components mentioned above, the apparatus shown in FIG. 1 comprises a number of sensors, viz.

- a chamber-pressure sensor 14 for sensing the pressure in the mold chamber 1,
- a first movement sensor 15 for sensing the length of the path of movement of the first squeeze plate 8,
- a second movement sensor 16 for sensing the length of the path of movement of the second squeeze plate 11,
- a first cylinder-pressure sensor 17 for sensing the pressure in the first hydraulic cylinder 10, as well as
- a second cylinder-pressure sensor 18 for sensing the pressure in the second hydraulic cylinder 13.

Finally, the apparatus shown comprises control means in the form of

- a first hydraulic valve 19 adapted to connect the first hydraulic cylinder 10 to a source of pressurized hydraulic liquid (not shown), and
- a second hydraulic valve 20 adapted to connect the second hydraulic cylinder 13 to the source mentioned above.

Further, the apparatus may be equipped with a number of sensing and control means (not shown) adapted to sense and control other parameters than those with which the present invention is concerned.

With a view to processing the signals from the various sensors and actuation of the control means based thereupon, the apparatus further comprises a control unit in the form of a computer 21 with associated screen 22 and keyboard 23, such as is commonly known in the control of industrial processes.

At this stage, it should be noted for the sake of good order that the computer 21 is assumed to be of the kind having a built-in clock of some kind, symbolized by a clock face 24.

The connecting lines 1721, 2119, 1521, 1421, 1621, 2120 and 1821 between the various parts of the apparatus, not described in detail in the present specification, carry four-digit reference numbers, in which the first two digits correspond to the reference number of the unit emitting signals, while the two last digits correspond to the reference number for the unit receiving the signals.

A first embodiment of the method according to the invention will now be described with reference to FIG. 2.

After having started the process at 202, the starting pressure $P_2$ for the second squeeze plate 11 is set in 204, said pressure being that pressure in the mold chamber 1, e.g. as sensed by the chamber-pressure sensor 14, at which the second squeeze plate 11 is to be set into movement.

Then according to 206, the first squeeze plate 8 is set in motion, while the valve 20, of course, is being held closed in order to prevent movement of the second squeeze plate 11, and the pressure $P_{MC}$ in the mold chamber is measured, e.g. by means of the chamber-pressure sensor 14.

According to 210 the question is now asked whether the mold-chamber pressure $P_{MC}$ is equal to or greater than the starting pressure $P_2$ adjusted according to 204. If the answer is "no", the measuring of the mold-chamber pressure $P_{MC}$ is continued as before, and when the answer at some moment in time becomes "yes", the second squeeze plate 11 is actuated according to 212, so that the compacting operation is now carried out with both the first squeeze plate 8 and the second squeeze plate 11 moving.

Then, the question is set in 214 whether the pressing is complete. This question may be answered on the basis of various criteria, e.g. the pressure in the mold chamber, but according to the invention it is preferred to use a suitably high value of the derivative of the mold-chamber pressure with respect to the movements of the squeeze plates, corresponding to the resistance of the compacted sand against further compacting, the use of this criterion having proved to cause the shaped bodies being formed to have the solidity desired.

When the answer to the question in 214 indicates that the pressing operation is in fact complete, the pressing operation is discontinued according to 216, and a new process may commence.

Figure 2:
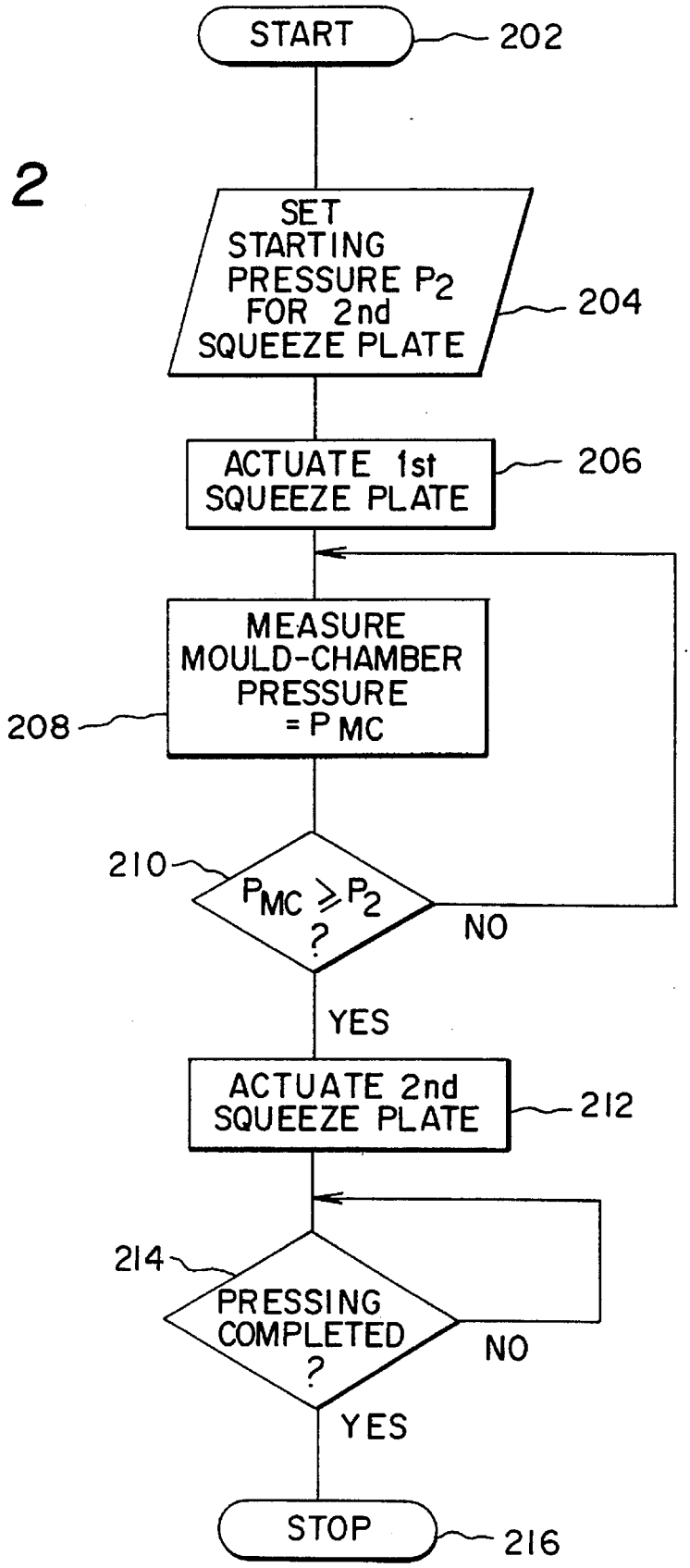
FIGS. 2–4 show three different exemplary embodiments of process diagrams that may be used as bases for programming the control means in the apparatus shown in FIG. 1.
Figure 3:
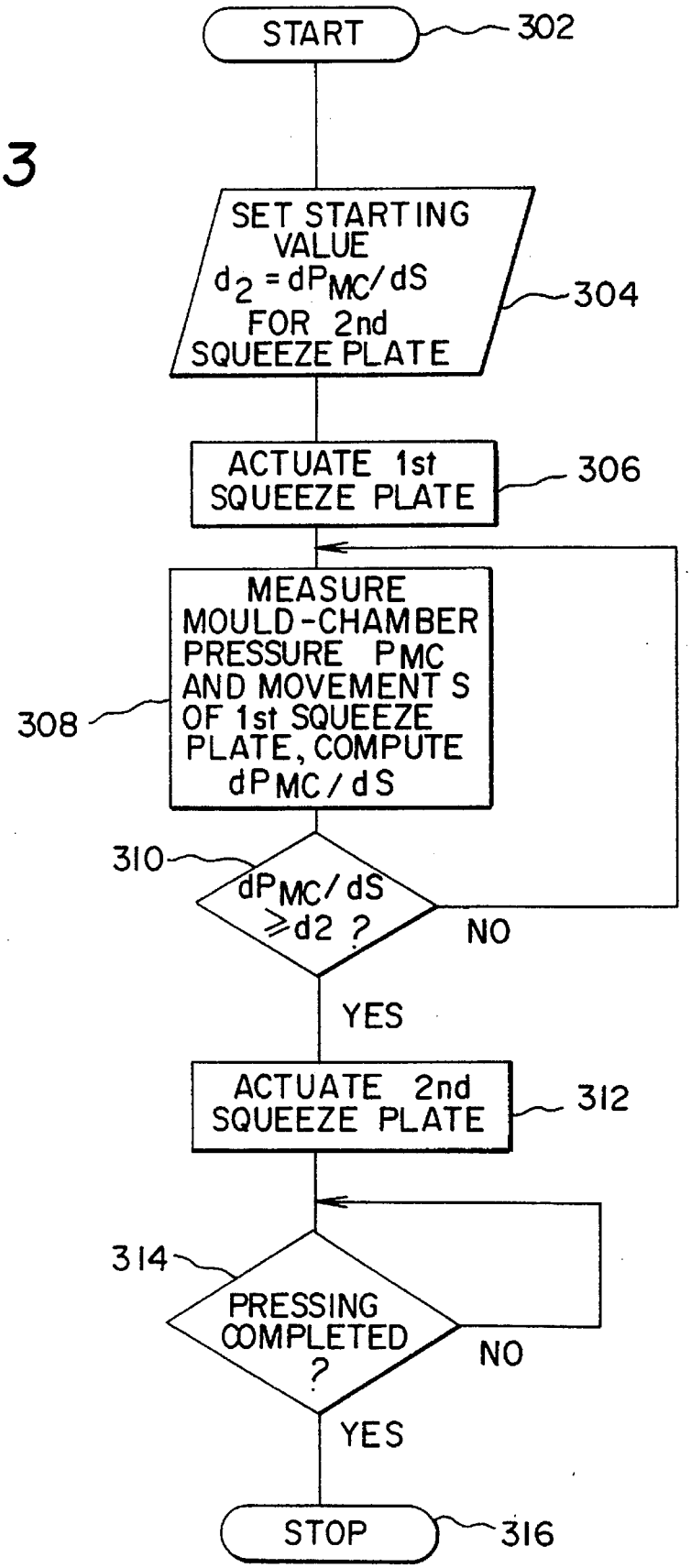
Figure 4:
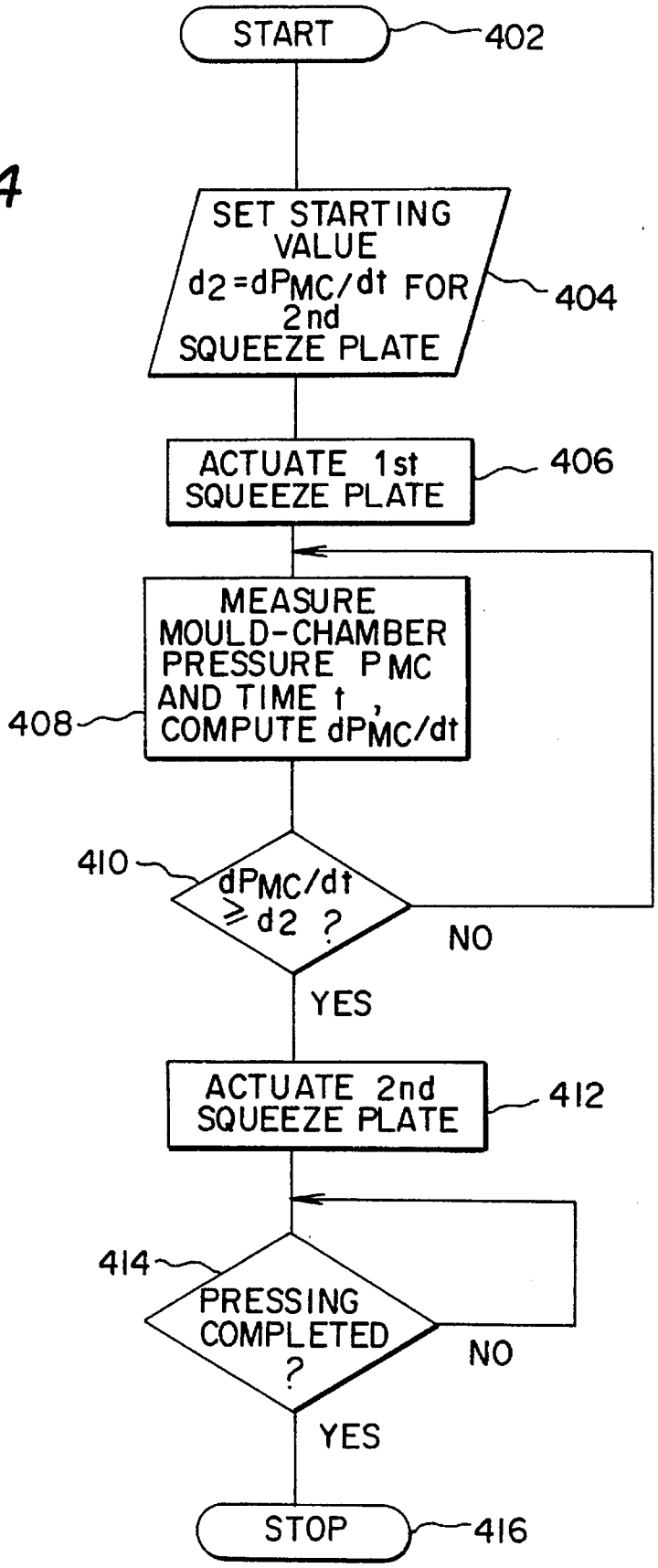

After reading the above description of FIG. 2, it should be possible to understand FIGS. 3 and 4 immediately where respective steps 202, 206, 212 and 216 are the same as respective steps 302, 306, 312, and 316 in FIG. 3 and respective steps 402, 406, 412, and in FIG. 4. It is also evident from 304, 308, 310 and 404, 408, 410 respectively that the parameter, which when reaching a certain predetermined value triggers the actuation of the second squeeze plate, is constituted by the derivative of the pressure in the mold chamber with respect to the path of movement of the first squeeze plate and with respect to time respectively.

In 314 and 414, the same criterion for the pressing having been completed as in 214 in FIG. 2 may be used, and with special reference to FIG. 3 it should be noted that the computation of the parameter to be used in this criterion has already been performed in 308 although with a view to comparing the result to a different criteria's value.

According to FIGS. 2–4, the mold-chamber pressure $P_{MC}$ is a part of or constitutes the parameter being used as a starting criterion for the second squeeze plate, and it is mentioned with reference to FIG. 2 that this pressure may be measured by means of the chamber-pressure sensor 14. In practice it is, however, frequently problematic to measure the mold-chamber pressure by using a pressure sensor situated in one of the walls of the chamber, but fortunately, it is also possible to measure the mold-chamber pressure indirectly by means of the two cylinder-pressure sensors 17 and 18. This does not necessarily result in the same values during the entire pressing operation as when using a chamber-pressure sensor, but any necessary corrections may easily be carried out by experiment. Thus, use of the cylinder pressure in place of the mold-chamber pressure provides a parameter depending on (or varying concurrently with) the mold-chamber pressure.

With regard to those measurements of the path of movement of the squeeze plates that are necessary in the embodiment shown in FIG. 3, these measurements may be carried out by means of the two movement sensors 15 and 16, in a manner known per se sensing the operational movements of the two squeeze plates 8 and 11. These pressing movements are started by opening the hydraulic valves 19 and 20 respectively, so that the associated hydraulic cylinders 10 and 13 begin to operate.

In summary then, the parameter causing initiation of the movement of the second squeeze member is chosen as: the pressure in the mold chamber; a parameter depending on (or varying concurrently with) the mold pressure; a parameter derived from an increase in the mold pressure; or a derivative with respect to the length of the path of the squeeze movement of the first squeeze member or with respect to time of a) the pressure in the mold chamber, b) the force (pressure area) with which the first squeeze member is moved, c) the force (pressure area) acting upon the second squeeze member during the squeeze movements of the first squeeze member, or d) a parameter varying concurrently with such pressures and forces.

It will be evident from FIGS. 2–4 that the processes shown are solely single processes, i.e. they solely relate to the making of a single shaped body in the mold chamber 1. Persons skilled in this technology will, however, know how to provide the process diagrams with the requisite loops, and how to combine the mold chamber with automatically operating "sand-shooting" equipment and equipment for removing the molds or mold parts having been produced, in order to make it possible to utilize the present invention in the mass production of molds or mold parts, such as used inter alia in the well-known DISAMATIC® machines.

Finally, for the sake of good order it should be noted that the process diagrams shown in FIGS. 2–4 are, of course, intended to be used as bases for the programs to be entered into the computer 21, e.g. by reading-in through the keyboard 23 and checking on the screen 22.

We claim:

1. A method of manufacturing a mold or a mold part for casting by compacting particulate material in a mold chamber, said method comprising the steps of:

providing a mold chamber and particulate material within the mold chamber, the mold chamber having surrounding walls which include first and second squeeze members capable of moving towards each other, at least one of the first and second squeeze members supporting a pattern which is shaped corresponding to a desired shape of a corresponding part of an object to be cast using the mold or mold part;

initially commencing a squeezing movement only of the first squeeze member against the material in the mold chamber;

measuring one of (a) a derivative with respect to the length of the path of the squeeze movement of the first squeeze member or with respect to time of a pressure in the mold chamber with which individual particles of the particulate material are pressed together which pressure increases as the first squeeze member is moved or (b) a derivative with respect to the length of the path of the squeeze movement of the first squeeze member or with respect to time of a parameter varying concurrently with said pressure in the mold chamber;

determining whether the squeezing movement of the first squeezing member has caused a predetermined change in said derivative; and initiating a squeezing movement of the second squeeze member when the predetermined change in said derivative has occurred.

2. A method of manufacturing a mold or mold part as claimed in claim 1 wherein said measuring step includes the step of measuring a derivative of a force with which the first squeeze member is moved or a parameter varying concurrently therewith.

3. A method of manufacturing a mold or mold part as claimed in claim 1 wherein said measuring step includes the step of measuring a derivative of a force acting upon the second squeeze member or a parameter varying concurrently therewith.

4. A method of manufacturing a mold or mold part as claimed in claim 1 wherein said measuring step includes the step of measuring a derivative with respect to time of the pressure or a parameter varying concurrently therewith.

5. An apparatus for manufacturing a mold or mold part for casting comprising:

a mold chamber;

a filling means for filing particulate material into said mold chamber;

a first squeeze member and a second squeeze member which are oppositely facing and which form limits to said mold chamber;

a pattern carried by one of said first or second squeeze members;

respective first and second moving means for respectively moving said first and second squeeze members towards one another in said mold chamber;

a measuring means for measuring one of (a) a derivative of a pressure in said mold chamber with which individual particles of the particulate material are pressed together or (b) a derivative with respect to the length of the path of the squeeze movement of the first squeeze member or with respect to time of a parameter varying concurrently with said pressure;

a control means for controlling said first and second moving means of the respective said first and second squeeze members after filling of said mold chamber with particulate material, said control means being used for (a) initiating a squeezing movement of said first squeeze member against particulate material in said mold chamber while said second squeeze member is held stationary, (b) determining whether the squeezing movement of the first squeezing member has caused a predetermined change in said derivative, and (c) when the predetermined change has occurred in said derivative, initiating a squeezing movement of said second squeeze member against the particulate material in said mold chamber whereby the mold or mold part is cast in the particulate material squeezed in said mold by said first and second squeeze members.

6. An apparatus for manufacturing a mold or mold part as claimed in claim 5 wherein said measuring means measures a force with which the first squeeze member is moved or a parameter varying concurrently therewith.

7. An apparatus for manufacturing a mold or mold part as claimed in claim 5 wherein said measuring means measures a force acting upon the second squeeze member or a parameter varying concurrently therewith.

8. An apparatus for manufacturing a mold or mold part as claimed in claim 5 wherein said measuring means measures a derivative with respect to time of the pressure or a parameter varying concurrently therewith.

9. A method of manufacturing a mold or a mold part for casting by compacting particulate material in a mold chamber, said method comprising the steps of:

providing a mold chamber and particulate material within the mold chamber, the mold chamber having surrounding walls which include first and second squeeze members capable of moving towards each other, at least one of the first and second squeeze members supporting a pattern which is shaped corresponding to a desired shape of a corresponding part of an object to be cast using the mold or mold part;

initially commencing a squeezing movement only of the first squeeze member against the material in the mold chamber;

measuring a derivative of pressure in the mold chamber with respect to a length of the path of movement of the first squeeze plate and with respect to time respectively with which individual particles of the particulate material are pressed together which pressure increases as the first squeeze member is moved;

determining whether the squeezing movement of the first squeezing member has caused a predetermined change in said derivative; and initiating a squeezing movement of the second squeeze member when the predetermined change in said derivative has occurred.

* * * * *